US010378269B2

(12) United States Patent
Murphy

(10) Patent No.: US 10,378,269 B2
(45) **Date of Patent: *Aug. 13, 2019**

(54) SILL PAN

(71) Applicant: EXTERIOR RESEARCH AND DESIGN, L.L.C., Seattle, WA (US)

(72) Inventor: Colin R. Murphy, Seattle, WA (US)

(73) Assignee: EXTERIOR RESEARCH AND DESIGN, L.L.C., Seattle, WA (US)

( * ) Notice: Subject to any disclaimer, the term of this patent is extended or adjusted under 35 U.S.C. 154(b) by 206 days.

This patent is subject to a terminal disclaimer.

(21) Appl. No.: 15/239,493

(22) Filed: Aug. 17, 2016

(65) Prior Publication Data

US 2017/0051553 A1 Feb. 23, 2017

Related U.S. Application Data

(63) Continuation of application No. 14/487,850, filed on Sep. 16, 2014, now Pat. No. 9,447,626.

(60) Provisional application No. 61/878,442, filed on Sep. 16, 2013.

(51) Int. Cl.

| | |
|---|---|
| ***B21D 5/16*** | (2006.01) |
| ***E06B 1/62*** | (2006.01) |
| ***E06B 1/70*** | (2006.01) |
| ***E06B 7/14*** | (2006.01) |
| ***B21D 11/10*** | (2006.01) |
| ***B21D 28/00*** | (2006.01) |

(52) U.S. Cl.

CPC ..... *E06B 1/62* (2013.01); *B21D 28/00* (2013.01); *E06B 1/70* (2013.01); *E06B 1/702* (2013.01); *E06B 7/14* (2013.01); *B21D 5/16* (2013.01); *B21D 11/10* (2013.01); *E06B 2001/628* (2013.01); *Y10T 29/49623* (2015.01)

(58) Field of Classification Search

CPC ..... E06B 2001/628; E06B 1/70–705; E06B 7/14; E06B 1/62; E06B 1/64; E06B 1/68; B21D 5/00; B21D 5/16; B21D 11/10; B21D 53/74; Y10T 29/49623

See application file for complete search history.

(56) References Cited

U.S. PATENT DOCUMENTS

| | | | | |
|---|---|---|---|---|
| 5,018,333 | A | 5/1991 | Bruhm | |
| 5,899,026 | A * | 5/1999 | Williams | E04D 1/36 52/58 |
| 6,401,402 | B1 | 6/2002 | Williams | |
| 7,201,820 | B2 | 4/2007 | Wiercinski | |
| 7,676,996 | B2 * | 3/2010 | Teodorovich | E06B 1/62 52/204.2 |
| 7,775,004 | B2 | 8/2010 | Allen | |
| 7,798,193 | B2 | 9/2010 | Ford | |
| 7,874,121 | B1 | 1/2011 | Hohmann, Jr. | |
| 2005/0011140 | A1 | 1/2005 | Ackerman, Jr. et al. | |

(Continued)

*Primary Examiner* — Matthew P Travers

(74) *Attorney, Agent, or Firm* — Avery N. Goldstein; Blue Filament Law

(57) ABSTRACT

A method for forming a sill pan is provided that includes the measurement of a width and length of an opening sill to be sealed. A piece of flexible sill pan material is cut based on the measured opening sill. Fold lines and cuts are created in the piece to form the sill pan. The resulting sill pan is readily formed to have at least one attribute of self-adherence, draining without shims, nail hole self-sealing, and provision of dams without resort to frame cutting.

7 Claims, 1 Drawing Sheet

(56) References Cited

U.S. PATENT DOCUMENTS

| | | | | |
|---|---|---|---|---|
| 2005/0210768 | A1 | 9/2005 | Lawson et al. | |
| 2005/0252131 | A1 | 11/2005 | Bushberger | |
| 2006/0101726 | A1 | 5/2006 | Collins | |
| 2008/0010917 | A1 | 1/2008 | Hopkins et al. | |
| 2008/0139178 | A1 | 6/2008 | Kawasaki | |
| 2009/0038230 | A1 | 2/2009 | Sargent | |
| 2010/0139178 | A1 | 6/2010 | Ehrman et al. | |
| 2010/0162634 | A1 | 7/2010 | Teodorovich | |
| 2014/0041316 | A1* | 2/2014 | Norwood | E06B 1/62 52/58 |

* cited by examiner

SILL PAN

RELATED APPLICATIONS

This application is a continuation of U.S. Non-provisional application Ser. No. 14/487,850 filed Sep. 16, 2014 that in turn claims priority benefit of U.S. Provisional Application Ser. No. 61/878,442 filed Sep. 16, 2013; the contents of which are hereby incorporated by reference.

FIELD OF THE INVENTION

The present invention in general relates to building products for weatherproofing window and door installations and in particular, to a sill pan adapted to waterproof a sill surface and a method for forming the sill pan.

BACKGROUND OF THE INVENTION

The incursion of unwanted air and/or moisture into buildings and homes around door and window joints is a major concern for builders, property owners, and occupants. The penetration of air and/or moisture is a serious concern, and may result in exterior and interior damage if not prevented or corrected in a timely manner. In addition, heat losses caused by air leakage around building openings have taken on new significance due to today's high energy costs. Sealing such openings has typically been accomplished by caulking or using putty-like compound around openings between door and window frames to seal the gaps and prevent inward seepage of air and/or water into a building.

An existing approach to sealing window joints is the use of a sill pan to flash windows into a window opening. The sill pan is typically made of metal and is formed in an off-site fabrication shop based on measurements made of the opening at the building site. Typically, there are variations in the size for each window so each pan is somewhat unique. Furthermore, if the measurement is not precise, the pan will not fit correctly, and must be remade or swapped around to make sure the sill pans fit each opening. An additional problem with metal sill pans is that sill pans create a thermal short from outside to inside of the window to be sealed due to the pans large mass, and creates condensation on the inside of the window at the sill.

A recent more common practice is the use of polyvinyl chloride (PVC) for sealing panels for windows. The PVC is made in two pieces that slide so they can be used in residential applications, which have become more common. The PVC based sill pans slide to fit the opening and are then sealed with glue or sealant to make a watertight assembly. The PVC based products can have built-in shims and other elements to create a slope for directing water drainage. The PVC material is usually thicker than metal. However, plasticized PVC can also have compatibility problems with bitumen based membranes. Furthermore, the PVC based sill product has openings at the point of connection of the two pieces that can be prone to leakage. Both the aluminum and plastic sill pans need to be bonded to the underlying surface so no water can pass underneath, which is typically achieved with non-skinning butyl beads or tapes.

A further trend has been the increased use of vinyl windows in recent years. However, it has generally been recognized that vinyl windows take in water and can leak at the sills notwithstanding the weep holes built into the frame at the sill. Therefore, the use of vinyl windows has significantly increased the use of sill pans, not just flashing membranes. Many manufacturers now encourage the use of sill pans. An available option is to create a pan from a self-adhered membrane cutting it to fit. A self-adhered membrane that is cut to fit has the advantage of sealing to the underside of the window and forming the product in the field that it is not rigid. The self-adhered membrane will not allow drainage since the window will create a seal unless shims are put under the window to create sufficient space to create drainage. Many manufacturers of vinyl windows want the window to be fully supported which means shims do not work with their vinyl window designs. Furthermore, the membrane is not very durable and the cutting of the membrane can create joints and pinholes that must be filled with sealant to make sure a seal is created.

While many materials and approaches for sealing window and door joints have been tried, there still exists a need for a material and method of application that can be used for a sill pan that has the advantages of a self-adhered membrane, but can drain without shims, and has sufficient sealing materials to seal around nail holes, while being thin enough to properly function and provide end and back dams without cutting the material.

SUMMARY OF THE INVENTION

A method for forming a sill pan is provided that includes the measurement of a width and length of an opening sill to be sealed. A piece of flexible sill pan material is cut based on the measured opening sill. Fold lines and cuts are created in the piece to form the sill pan. The resulting sill pan is readily formed to have at least one attribute of self-adherence, draining without shims, nail hole self-sealing, and provision of dams without resort to frame cutting.

DESCRIPTION OF THE INVENTION

Figure 1A:
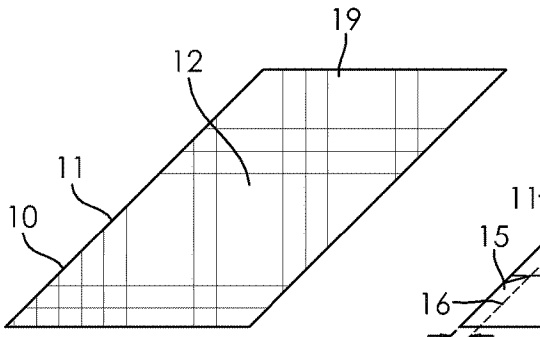
FIGS. 1A-1D illustrate a method for forming a sill pan from a sheet material according to embodiments of the invention.

The present invention has utility for sealing window and door joints and provides a material and method of forming and application of the seal that can be used for a sill pan that has the advantages of a self-adhered membrane, but can drain without shims, and has sufficient sealing materials to seal around nail holes, while being thin enough to properly function and provide end and back dams without cutting the material.

Embodiments of the inventive sill pan may be formed from a waffled aluminum membrane that has a thick butyl backed adhesive on the back, or other materials that inhibit moisture and can be used in the inventive method of forming sill pans. The waffled aluminum membrane is sold as a roll good that can be cut with scissors. The roll goods can be taken to an application or construction site and cut to size as required. In the inventive method for forming a sill pan, instead of cutting and sealing to form the pan, the material is folded to form the end and back dams so there is no hole or bonded surface. In the inventive method, the end dams and back dams of a sill pan may be formed to any required height. In forming the sill pan, the waffled aluminum membrane material is rigid enough to stand up by itself, so that the majority of a backing may be removed leaving the last one-inch, so the material can be turned up when the sill trim at the back of the window interior is installed. Alternatively in an embodiment, the back dam may be formed with a metal angle to which the back dam can be immediately bonded creating a free standing back dam. The waffle pattern on the face of the aluminum membrane creates a drainage course. If water were to travel through the window the pan will pick it up. The waffle pattern in the membrane material allows the water to drain to the exterior without putting the window to be sealed on shims. The pan can be sloped by gently sloping the sill framing or adding a continuous wood 'chair' with very gentle sloping. The thick butyl backing of the membrane material acts to seal around penetrations. The aluminum surface is compatible with all materials currently in use as a flashing material. Packaged as a rolled good, the aluminum membrane allows for the expansion of the sill to the exterior to any amount the installer requires.

In installations where metal sills are usually exposed, embodiments of the inventive sill pan are more appropriate for a 'nail-on' window that used to be sealed with a nailing flange on all four sides. The concept used by builders today is to leave the sill open to allow and water that enters to drain out instead of entering the building, but to avoid air from entering the building to create an exterior air barrier. The waffled aluminum membrane material achieves the desired sealing performance by allowing drainage at the bottom, and sealing the window to the back dam with a butyl or polyurethane seal. Self-adhered membranes typically have a polyethylene face that serves as a water impervious barrier, and is not a good surface for sealant bonding. However, while the aluminum face of the waffled aluminum membrane material, used in embodiments of the inventive sill pan, also has a zero perm it still also provides a good sealing surface. The aluminum membrane is thick enough to provide rigidity, but thin enough to cut with scissors and to create a thin profile.

Figure 1B:
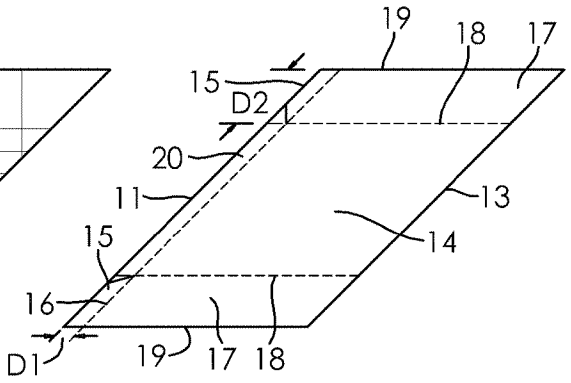
Figure 1C:
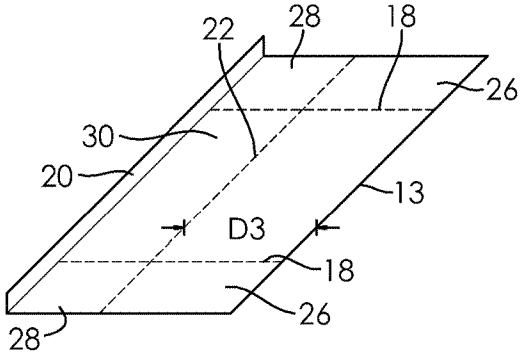
Figure 1D:
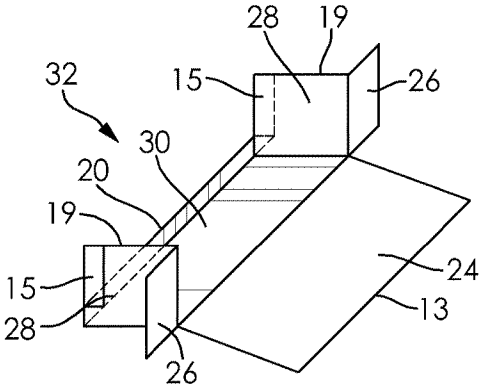

Referring now to the figures, FIGS. 1A-1D illustrate an inventive method for forming a sill pan 32. It is noted that a waffled or dimpled aluminum membrane is the material used in the example embodiment shown; however additional sheet materials may be used to carry out the inventive method. In FIG. 1A, a rectangular sheet of flexible sill pan material 10 with the dimple or waffle side 12 showing is laid out and cut to a required size for a window sealing application. In general the inner 11 and outer 13 edges are along the long dimension of the cut sheet 10. In FIG. 1B, the smooth surface 14 of the flexible sill pan material 10 is shown, and the surface is measured and marked as follows with a first fold line 16 that defines the height of a back dam 20 at a first distance measured from the inner edge, and a second fold line 18 that defines a rectangular area 17 on opposing sides of the flexible sill pan made up of folded segments 26 and 28 (see FIG. 1C) that define side flaps and the end dams, respectively. The first fold line 16 is parallel to the long side of the rectangular sheet 10. The pair of second fold lines 18 are perpendicular to the first fold line 16 and are parallel to short side dimension of the sheet 10 at a second distance (D2) measured from the side edges 19. In FIG. 1C, a third fold line 22 is added that is parallel to the first fold line 16 at a third distance (D3) as measured from the outer edge, and bisects the sheet 10. Fold line 22 defines the width of the seat 30 of sill pan 10 for seating the window frame, and the downward flap 24 that extends down the wall 34 (see FIG. 2) below the window sill. The fold along third fold line 22 also creates a drip edge. Additionally in FIG. 1C, the back dam 20 is folded upward along fold line 16 relative to the seat 30. In FIG. 1D, a cut is made along second fold lines 18 that extend from the outer edge 13 until the third fold line 22, and the segments 26 and 28 that form the side flaps and the end dams, respectively are bent upward and perpendicular to the seat 30. The side flaps 26 are subsequently bent away from the seat 30 and made perpendicular to the end dams 28. The opposing ends 15 of back dam 20 that are defined by the area between the inner edge 11, first fold line 16, and second fold lines 18 are folded upward after a small cut is made to first fold line 16 that extends from the side edges 19 to the second fold line 18. The upward opposing ends 15 seal against the end dams 28. The entire sill pan 32 formed above is now ready to be placed in the opening for the window sealing application.

Figure 2:
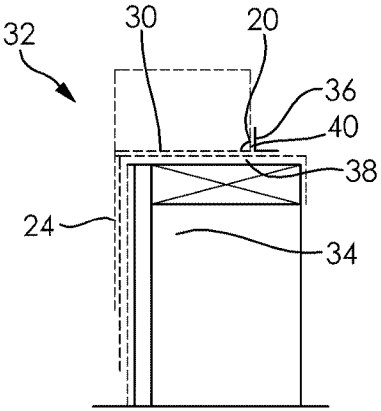
FIG. 2 is a side perspective cut away view of an installed sill pan according to embodiments of the invention.

FIG. 2 is a side perspective cut away view of an installed sill pan 32 in a building wall opening 34 prior to placement of a window frame (not shown) according to embodiments of the invention. As shown the downward flap 24 extends down the wall 34. Metal angle 36 provides vertical support to back dam 20, and seat section 30 of the flexible sill pan 32 fits onto the sill 38 of the window opening. A toe bead of sealant 40 is placed at the right angle bend between the seat 30 and back dam 20. When placing the window frame the bottom rear edge of the window frame is set into the toe bead of sealant 40.

The invention claimed is:

1. A method for forming a sill pan, said method comprising:

measuring a width and length of an opening sill to be sealed;

cutting a rectangular piece of flexible sill pan material based on the measured opening sill, said sill pan material having a first surface, a second surface opposite to the first surface, an inner edge, an outer edge, and a pair of side edges, where the inner edge and the outer edge are parallel to each other and perpendicular to the side edges of the flexible sill pan material;

creating a set of fold lines in said rectangular piece of flexible sill pan material to define a back dam along the inner edge, a downward flap along the outer edge, and a seat between said back dam and said downward flap of the sill pan;

placing said seat on the sill;

vertically supporting said back dam with a metal angle; and placing a toe bead of sealant at a fold line between said seat and said back dam wherein creating said set of fold lines comprises: creating a first fold line on said first surface that defines a height of said back dam at a first distance measured from the inner edge;

creating a set of two second fold lines on said first surf ace that are perpendicular to said first fold line and are parallel to said side edges at a second distance measured from both of said side edges; and creating a third fold line on said first surface parallel to said first fold line at a third distance as measured from the outer edge that defines a width of said seat of said sill pan for seating a window frame, and said downward flap.

2. The method of claim 1 wherein said second surface of said flexible sill pan material is waffled or dimpled.

3. The method of claim 1 wherein said flexible sill pan material is an aluminum membrane.

4. The method of claim 1 wherein said flexible sill pan material comprises a butyl backed adhesive.

5. A method for forming a sill pan, said method comprising:

measuring a width and length of an opening sill to be sealed;

cutting a rectangular piece of flexible sill pan material based on the measured opening sill, said sill pan material having a first surface, a second surface opposite to the first surface, an inner edge, an outer edge, and a pair of side edges, where the inner edge and the outer edge are parallel to each other and perpendicular to the side edges of the flexible sill pan material, and where the second surface of said flexible sill pan material is waffled or dimpled;

creating a set of fold lines in said rectangular piece of flexible sill pan material to define the sill pan, wherein creating said set of fold lines comprises creating a first fold line on said first surface that defines a height of a back dam at a first distance measured from the inner edge, creating a set of two second fold lines on said first surface that are perpendicular to said first fold line and are parallel to said side edges at a second distance measured from both of said side edges, and creating a third fold line on said first surface parallel to said first fold line at a third distance as measured from the outer edge that defines a width of a seat of said sill pan for seating a window frame, and a downward flap;

cutting said set of two second fold lines that extend from the outer edge until the third fold line; and cutting said first fold line from opposing sides from said side edges until said second fold lines to form opposing ends.

6. The method of claim 5 further comprising:

folding said first fold line upward to create the back dam that is perpendicular to said seat; and folding said set of two second fold lines upward to form two side flaps and end dams that are perpendicular to said seat.

7. The method of claim 6 further comprising:

bending said side flaps outward and perpendicular to said end dams; and bending said opposing ends upward to seal against said end dams.

* * * * *